US009345979B2

(12) United States Patent
Matthes et al.

(10) Patent No.: US 9,345,979 B2
(45) Date of Patent: May 24, 2016

(54) WALL MOUNTED TOY TRACK SET

(71) Applicant: Mattel, Inc., El Segundo, CA (US)

(72) Inventors: Robert William Matthes, Long Beach, CA (US); Stacy Lynn O'Connor, El Segundo, CA (US); Sang Joon Kwak, La Habra, CA (US)

(73) Assignee: Mattel, Inc., El Segundo, CA (US)

( * ) Notice: Subject to any disclaimer, the term of this patent is extended or adjusted under 35 U.S.C. 154(b) by 133 days.

(21) Appl. No.: 14/025,230

(22) Filed: Sep. 12, 2013

(65) Prior Publication Data

US 2014/0070015 A1 Mar. 13, 2014

Related U.S. Application Data

(60) Provisional application No. 61/699,956, filed on Sep. 12, 2012.

(51) Int. Cl.

| | |
|---|---|
| ***A63H 18/06*** | (2006.01) |
| ***A63H 18/02*** | (2006.01) |
| ***A63H 18/08*** | (2006.01) |

(52) U.S. Cl.

CPC ..... *A63H 18/06* (2013.01); *A63H 18/028* (2013.01); *A63H 18/08* (2013.01)

(58) Field of Classification Search

CPC ..... A63H 18/06; A63H 18/08; A63H 18/16; A63H 18/028

See application file for complete search history.

(56) References Cited

U.S. PATENT DOCUMENTS

| | | | |
|---|---|---|---|
| 469,948 | A | 3/1892 | Reed |
| 806,930 | A | 12/1905 | Smith |
| 812,595 | A | 2/1906 | Roberts |
| 831,907 | A | 9/1906 | Townsend |
| 889,169 | A | 6/1908 | Brothen |
| 1,113,945 | A | 10/1914 | Bain |
| 1,116,577 | A | 11/1914 | Dugger |
| 1,209,127 | A | 12/1916 | Corey |
| 1,244,457 | A | 10/1917 | Bain |
| 1,244,702 | A | 10/1917 | Christ |
| 1,247,226 | A | 11/1917 | Cole |
| 1,252,616 | A | 1/1918 | Reif |

(Continued)

FOREIGN PATENT DOCUMENTS

| | | | |
|---|---|---|---|
| CN | 201067632 | Y | 6/2008 |
| CN | 101687116 | A | 3/2010 |

(Continued)

OTHER PUBLICATIONS

European Search Report dated Nov. 13, 2013 for Application No. 13168331.0.

(Continued)

*Primary Examiner* — Zachary Kuhfuss

(74) *Attorney, Agent, or Firm* — Kolisch Hartwell, P.C.

(57) ABSTRACT

A toy vehicle track set is provided including a pair of arm members including a first arm member and a second arm member. The pair of arm member are movably mounted to the track set for movement between a first position and a second position. A toy vehicle carriage is pivotally mounted at a distal end of each of the pair of arm members. Each of the pair of arm members is coupled to one another such that as one of the arm members moves from its first position to its second position, the other of the arm members also moves from its first position to its second position.

13 Claims, 6 Drawing Sheets

(56) References Cited

U.S. PATENT DOCUMENTS

| | | | |
|---|---|---|---|
| 1,261,691 | A | 4/1918 | Bunkley |
| 1,279,271 | A | 9/1918 | Cole |
| 1,284,477 | A | 11/1918 | Seils |
| 1,287,450 | A | 12/1918 | Sabina et al. |
| 1,287,608 | A | 12/1918 | Austin |
| 1,295,504 | A | 2/1919 | Howard et al. |
| 1,301,552 | A | 4/1919 | Gaines |
| 1,314,238 | A | 8/1919 | Bain |
| 1,315,108 | A | 9/1919 | Gaines |
| 1,317,184 | A | 9/1919 | Voss |
| RE14,902 | E | 6/1920 | Gaines |
| 1,347,968 | A | 7/1920 | O'Doie |
| 1,351,981 | A | 9/1920 | Zipf |
| 1,355,636 | A | 10/1920 | Bain |
| 1,361,449 | A | 12/1920 | Danner |
| 1,392,727 | A | 10/1921 | Welsh |
| 1,454,173 | A | 5/1923 | Keiner |
| 1,472,783 | A | 11/1923 | Bauer |
| 1,478,350 | A | 12/1923 | Okel |
| RE15,900 | E | 8/1924 | Hetzner |
| 1,523,244 | A | 1/1925 | Bain |
| 1,527,006 | A | 2/1925 | O'Reilly |
| 1,546,377 | A | 7/1925 | Gunderman |
| 1,560,181 | A | 11/1925 | Marx |
| 1,561,633 | A | 11/1925 | Bain |
| 1,568,492 | A | 1/1926 | Zabel |
| 1,599,699 | A | 9/1926 | Zabel |
| 1,599,982 | A | 9/1926 | Bauer |
| 1,617,846 | A | 2/1927 | Hawk |
| RE16,791 | E | 11/1927 | Hawk |
| 1,666,417 | A | 4/1928 | Harris |
| 1,696,532 | A | 12/1928 | Enloe |
| RE17,312 | E | 6/1929 | Beck |
| 1,715,891 | A | 6/1929 | Beck |
| 1,724,447 | A | 8/1929 | Abbott et al. |
| 1,725,536 | A | 8/1929 | Marx |
| 1,739,719 | A | 12/1929 | Gunderman |
| 1,748,184 | A | 2/1930 | Nichols |
| 1,758,061 | A | 5/1930 | Rentz et al. |
| 1,870,586 | A | 8/1932 | Platakis |
| 1,872,204 | A | 8/1932 | Wily |
| 2,128,863 | A | 8/1938 | Turrian |
| 2,211,220 | A | 8/1940 | Verplanck |
| 2,249,728 | A | 7/1941 | Cross |
| 2,336,773 | A | 12/1943 | Black et al. |
| 2,391,529 | A | 12/1945 | Walker |
| 2,392,722 | A | 1/1946 | Burlin |
| 2,400,013 | A | 5/1946 | Lowell et al. |
| 2,400,410 | A | 5/1946 | Hatcher |
| 2,419,990 | A | 5/1947 | Dishmaker |
| 2,434,571 | A | 1/1948 | Long |
| 2,531,564 | A | 11/1950 | Garbe |
| 2,616,699 | A | 11/1952 | Franks |
| 2,634,128 | A | 4/1953 | Reed |
| 2,655,116 | A | 10/1953 | Gowland |
| 2,672,709 | A | 3/1954 | Ernst |
| 2,756,687 | A | 7/1956 | Fields |
| 2,785,504 | A | 3/1957 | Kooistra, Sr. |
| 2,838,159 | A | 6/1958 | Siegfried |
| 2,853,301 | A | 9/1958 | Glass |
| 2,998,673 | A | 9/1961 | Rhodes |
| 2,999,689 | A | 9/1961 | Litwinczuk |
| 3,251,155 | A | 5/1966 | Bjork |
| 3,298,692 | A | 1/1967 | Glass et al. |
| 3,300,891 | A | 1/1967 | Glass et al. |
| 3,314,169 | A | 4/1967 | Wold |
| 3,343,793 | A | 9/1967 | Waser |
| 3,401,484 | A | 9/1968 | Anslover |
| 3,542,366 | A | 11/1970 | Schocker |
| 3,548,534 | A | 12/1970 | Beny et al. |
| 3,570,171 | A | 3/1971 | Shook |
| 3,572,713 | A | 3/1971 | Krause |
| 3,600,849 | A | 8/1971 | Faller |
| 3,621,602 | A | 11/1971 | Barcus et al. |
| 3,633,308 | A | 1/1972 | Yang |
| 3,666,264 | A | 5/1972 | Bartlett |
| 3,703,989 | A | 11/1972 | Tomiyama |
| 3,708,116 | A | 1/1973 | Woodward |
| 3,712,538 | A | 1/1973 | Starr et al. |
| 3,726,476 | A | 4/1973 | Porter et al. |
| 3,734,404 | A | 5/1973 | Baynes et al. |
| 3,735,923 | A | 5/1973 | Brigham et al. |
| 3,795,983 | A | 3/1974 | Gallagher et al. |
| 3,803,756 | A | 4/1974 | Strongin |
| 3,818,628 | A | 6/1974 | Ensmann et al. |
| 3,860,238 | A | 1/1975 | Kojima |
| 3,908,303 | A | 9/1975 | McKay et al. |
| 3,986,296 | A | 10/1976 | Hamano |
| 4,037,355 | A | 7/1977 | Street |
| 4,055,913 | A | 11/1977 | Sindelar |
| 4,068,402 | A | 1/1978 | Tanaka |
| 4,091,561 | A | 5/1978 | Kimura |
| 4,094,089 | A | 6/1978 | Sano |
| 4,128,964 | A | 12/1978 | Ogasawara |
| 4,140,276 | A | 2/1979 | Halford |
| 4,146,991 | A | 4/1979 | Sano |
| 4,159,593 | A | 7/1979 | Miller |
| 4,161,279 | A | 7/1979 | Halford |
| 4,185,409 | A | 1/1980 | Cheng |
| 4,195,776 | A | 4/1980 | Lehmann |
| 4,203,247 | A | 5/1980 | Moe et al. |
| 4,219,198 | A | 8/1980 | Meyer et al. |
| 4,223,834 | A | 9/1980 | Fechter |
| 4,241,534 | A | 12/1980 | Larsson et al. |
| 4,249,733 | A | 2/1981 | Eddins et al. |
| 4,254,576 | A | 3/1981 | Matsumoto et al. |
| 4,267,661 | A | 5/1981 | Hanson |
| 4,291,488 | A | 9/1981 | Orenstein |
| 4,301,613 | A | 11/1981 | Kooistra, Sr. |
| 4,312,149 | A | 1/1982 | Iwao |
| 4,357,778 | A | 11/1982 | Matsumoto et al. |
| 4,373,693 | A | 2/1983 | Greenberger |
| 4,386,777 | A | 6/1983 | Prehodka |
| 4,394,961 | A | 7/1983 | Muller |
| 4,426,797 | A | 1/1984 | Burkemper et al. |
| 4,468,031 | A | 8/1984 | Barlow et al. |
| 4,475,303 | A | 10/1984 | Ribas et al. |
| 4,496,100 | A | 1/1985 | Schwager et al. |
| 4,513,966 | A | 4/1985 | Mucaro et al. |
| 4,519,789 | A | 5/1985 | Halford et al. |
| 4,557,064 | A | 12/1985 | Thompson |
| 4,558,867 | A | 12/1985 | Hippely |
| 4,564,197 | A | 1/1986 | Lambert et al. |
| 4,575,350 | A | 3/1986 | Hippely et al. |
| RE32,106 | E | 4/1986 | Lemelson |
| 4,585,166 | A | 4/1986 | Stephens |
| 4,609,363 | A | 9/1986 | Udagawa |
| 4,659,320 | A | 4/1987 | Rich et al. |
| 4,673,308 | A | 6/1987 | Reilly |
| 4,678,449 | A | 7/1987 | Udagawa |
| 4,708,685 | A | 11/1987 | Udagawa |
| 4,715,843 | A | 12/1987 | Ostendorff et al. |
| 4,734,076 | A | 3/1988 | Goldstein et al. |
| 4,795,394 | A | 1/1989 | Thompson |
| 4,874,342 | A | 10/1989 | Klitsner |
| 4,909,464 | A | 3/1990 | Levine et al. |
| 4,928,955 | A | 5/1990 | Chuan |
| 4,932,917 | A | 6/1990 | Klitsner |
| 4,951,872 | A | 8/1990 | Sheffield |
| 4,961,716 | A | 10/1990 | Hippely et al. |
| 5,022,884 | A | 6/1991 | Hippely et al. |
| 5,075,515 | A | 12/1991 | Yoneda et al. |
| 5,078,642 | A | 1/1992 | Glessner |
| 5,102,133 | A | 4/1992 | Chilton et al. |
| 5,107,601 | A | 4/1992 | Semchuck |
| 5,161,104 | A | 11/1992 | Fox et al. |
| 5,174,569 | A | 12/1992 | Ngai |
| 5,254,030 | A | 10/1993 | Ostendorff et al. |
| 5,299,969 | A | 4/1994 | Zaruba |
| 5,312,285 | A | 5/1994 | Rieber et al. |
| 5,342,048 | A | 8/1994 | Jones et al. |
| 5,344,143 | A | 9/1994 | Yule |
| 5,370,571 | A | 12/1994 | Bosch |
| 5,392,987 | A | 2/1995 | Ropers et al. |

(56) References Cited

U.S. PATENT DOCUMENTS

| | | | |
|---|---|---|---|
| 5,419,066 | A | 5/1995 | Harnois et al. |
| 5,473,833 | A | 12/1995 | Ostrovsky |
| 5,480,115 | A | 1/1996 | Haltof |
| 5,542,668 | A | 8/1996 | Casale et al. |
| 5,586,923 | A | 12/1996 | Hippely et al. |
| 5,735,724 | A | 4/1998 | Udagawa |
| 5,767,655 | A | 6/1998 | Ostendorff et al. |
| 5,785,573 | A | 7/1998 | Rothbarth et al. |
| 5,803,782 | A | 9/1998 | Selton |
| 5,846,018 | A | 12/1998 | Frobosilo et al. |
| 5,855,501 | A | 1/1999 | Kato et al. |
| 5,899,011 | A | 5/1999 | Brinkman |
| 5,899,789 | A | 5/1999 | Rehkemper et al. |
| 5,967,052 | A | 10/1999 | Prokopf |
| 6,000,992 | A | 12/1999 | Lambert |
| 6,026,603 | A | 2/2000 | Kump et al. |
| 6,056,620 | A | 5/2000 | Tobin |
| 6,170,754 | B1 | 1/2001 | Halford |
| 6,241,573 | B1 | 6/2001 | Ostendorff et al. |
| 6,358,112 | B1 | 3/2002 | Lambert et al. |
| 6,409,132 | B2 | 6/2002 | Heisler et al. |
| 6,439,955 | B1 | 8/2002 | Feketo |
| 6,478,654 | B1 | 11/2002 | Rehkemper et al. |
| 6,508,179 | B2 | 1/2003 | Annis et al. |
| 6,640,453 | B2 | 11/2003 | Eisenmenger |
| 6,647,893 | B1 | 11/2003 | Fugitt et al. |
| 6,676,480 | B2 | 1/2004 | Sheltman |
| 6,766,585 | B2 | 7/2004 | Thomas |
| 6,783,419 | B1 | 8/2004 | Paukert et al. |
| 6,862,997 | B2 | 3/2005 | Bussink |
| 6,951,307 | B2 | 10/2005 | Lin |
| 6,951,497 | B1 | 10/2005 | Ngan |
| 6,951,498 | B2 | 10/2005 | Rudell |
| 6,953,377 | B2 | 10/2005 | Quercetti |
| D511,961 | S | 11/2005 | Jordan |
| 6,976,316 | B1 | 12/2005 | Patterson |
| 7,066,783 | B2 | 6/2006 | Fischer |
| 7,325,348 | B2 | 2/2008 | Mueller et al. |
| 7,353,758 | B2 | 4/2008 | Murray |
| 7,373,731 | B2 | 5/2008 | Nyberg |
| 7,517,272 | B2 | 4/2009 | Bedford et al. |
| 7,527,156 | B2 | 5/2009 | Wisnoski et al. |
| 7,549,906 | B2 | 6/2009 | Bedford et al. |
| 7,600,757 | B1 | 10/2009 | Matilla et al. |
| 7,600,859 | B2 | 10/2009 | Huang et al. |
| 7,614,931 | B2 | 11/2009 | Nuttall |
| 7,618,302 | B2 | 11/2009 | Collins et al. |
| 7,628,673 | B2 | 12/2009 | Bedford et al. |
| 7,651,398 | B2 | 1/2010 | Ostendorff et al. |
| 7,690,964 | B2 | 4/2010 | Nuttall et al. |
| 7,708,317 | B2 | 5/2010 | Leblanc |
| 7,766,720 | B2 | 8/2010 | Ostendorff |
| 7,770,811 | B2 | 8/2010 | Belding |
| 7,857,679 | B2 | 12/2010 | O'Connor et al. |
| 8,162,716 | B2 | 4/2012 | Nuttall |
| 8,430,712 | B2 | 4/2013 | O'Connor et al. |
| 8,608,527 | B2 | 12/2013 | O'Connor et al. |
| 8,690,462 | B2 | 4/2014 | Shaw et al. |
| 8,690,632 | B2 | 4/2014 | O'Connor et al. |
| 8,747,180 | B2 | 6/2014 | O'Connor et al. |
| 8,814,628 | B2 | 8/2014 | O'Connor et al. |
| 2003/0220044 | A1 | 11/2003 | Andrews et al. |
| 2003/0224697 | A1 | 12/2003 | Sheltman et al. |
| 2004/0078991 | A1 | 4/2004 | Thomas |
| 2005/0287915 | A1 | 12/2005 | Sheltman et al. |
| 2005/0287919 | A1 | 12/2005 | Sheltman et al. |
| 2006/0027779 | A1 | 2/2006 | McGuire |
| 2006/0277779 | A1 | 12/2006 | Bauer |
| 2006/0286896 | A1 | 12/2006 | Bedford et al. |
| 2006/0286897 | A1 | 12/2006 | Bedford et al. |
| 2007/0012636 | A1 | 1/2007 | Wisnoski et al. |
| 2007/0049160 | A1 | 3/2007 | Matthes et al. |
| 2007/0128969 | A1 | 6/2007 | Shrock et al. |
| 2007/0209543 | A1 | 9/2007 | Beaulieu et al. |
| 2008/0064295 | A1 | 3/2008 | Abrams |
| 2008/0066560 | A1 | 3/2008 | Yu et al. |
| 2008/0070474 | A1 | 3/2008 | Nuttall |
| 2008/0268743 | A1 | 10/2008 | O'Connor et al. |
| 2009/0075558 | A1 | 3/2009 | Ostendorff |
| 2010/0056015 | A1 | 3/2010 | Nuttall |
| 2010/0112896 | A1 | 5/2010 | Chang et al. |
| 2010/0184353 | A1 | 7/2010 | Jobe |
| 2010/0199598 | A1 | 8/2010 | Townsend et al. |
| 2010/0273394 | A1 | 10/2010 | O'Connor et al. |
| 2010/0291833 | A1* | 11/2010 | O'Connor et al. ..... 446/429 |
| 2011/0086574 | A1* | 4/2011 | Nuttall et al. ..... 446/429 |
| 2011/0124265 | A1 | 5/2011 | O'Connor et al. |
| 2011/0269372 | A1 | 11/2011 | Nuttall |
| 2012/0052766 | A1 | 3/2012 | Payne |
| 2012/0052767 | A1 | 3/2012 | Martino et al. |
| 2012/0061484 | A1 | 3/2012 | Payne et al. |
| 2012/0062766 | A1 | 3/2012 | Park |
| 2012/0115393 | A1 | 5/2012 | Moh et al. |
| 2012/0164914 | A1 | 6/2012 | O'Connor et al. |
| 2012/0276808 | A1 | 11/2012 | Nuttall et al. |
| 2012/0322342 | A1 | 12/2012 | De La Torre |
| 2013/0288568 | A1 | 10/2013 | Schmid et al. |
| 2014/0070015 | A1 | 3/2014 | Matthes et al. |

FOREIGN PATENT DOCUMENTS

| | | | |
|---|---|---|---|
| DE | 440375 | C | 2/1927 |
| DE | 575170 | C | 4/1933 |
| DE | 4403361 | A1 | 8/1995 |
| GB | 2043469 | A | 10/1980 |
| JP | 07-328241 | A | 12/1995 |
| WO | 88-04191 | A1 | 6/1988 |
| WO | 2011137433 | A2 | 3/2011 |
| WO | 2012027737 | A2 | 1/2012 |
| WO | 2012027737 | A3 | 3/2012 |
| WO | 2012027753 | A2 | 3/2012 |
| WO | 2012027753 | A3 | 3/2012 |

OTHER PUBLICATIONS

European Search Report dated Nov. 5, 2013 for Application No. 13184129.8.

Partial European Search Report for Application No. 13187427.3-1658; Dated: Feb. 5, 2014.

International Search Report dated Apr. 9, 2012 for International Application No. PCT/US2011/049587.

Written Opinion dated Apr. 9, 2012 for International Application No. PCT/US2011/049587.

English Translation of Abstract CN201067632.

English Translation of Abstract CN101687116.

English Translation of Chinese Office Action for Application No. 2013101901814 dated Feb. 3, 2015.

Chinese Office Action for Application No. 2013101901814 dated Feb. 3, 2015.

* cited by examiner

WALL MOUNTED TOY TRACK SET

CROSS REFERENCE TO RELATED APPLICATIONS

This application claims the benefit of U.S. Provisional Patent Application Ser. No. 61/699,956 filed Sep. 12, 2012, the contents of which are incorporated herein by reference thereto.

BACKGROUND

Various embodiments of the present invention are related to toys. In particular, the various embodiments relate to a track set on which toy vehicles travel.

Toy vehicle track sets have been popular for many years and generally include one or more track sections arranged to form a path around which one or more toy vehicles can travel. Toy vehicles which may be used on such track sets may be either self-powered vehicles or may receive power from an external source.

Accordingly, it is desirable to provide toy track set with features that provide unique paths for the toy vehicles of the toy track to travel on.

BRIEF SUMMARY OF INVENTION

In one embodiment a toy vehicle track set is provided including a pair of arm members including a first arm member and a second arm member. The pair of arm member are movably mounted to the track set for movement between a first position and a second position. A toy vehicle carriage is pivotally mounted at a distal end of each of the pair of arm members. Each of the pair of arm members is coupled to one another such that as one of the arm members moves from its first position to its second position, the other of the arm members also moves from its first position to its second position.

In another exemplary embodiment, a toy vehicle track set is provided includes a carriage configured to receive a toy vehicle and a counterweight. The counterweight has a weight greater than the weight of the carriage. The carriages and the counterweight are configured to move between a first position and a second position. When a toy vehicle is received in the carriage, the weight of the toy vehicle and the carriage overcomes the weight of the counterweight in order to move the toy vehicle form a first track segment to a second track segment.

In another embodiment, a method of transferring toy vehicles vertically along a path of track set is provided. The method including the steps of: transferring the toy vehicles vertically along the path by a pair of arm members rotatably mounted to a vertical surface, the pair of arm members configured for movement about the track set for movement between a first position and a second position in order to transfer the toy vehicles vertically along the path; pivotally mounting a toy vehicle carriage to a distal end of each of the pair of arm members; and wherein each of the pair of arm members are coupled to one another such that as one of the pair of arm members moves from its first position to its second position, the other one of the pair of arm members also moves from its first position to its second position and wherein each toy vehicle carriage is configured to receive a toy vehicle from a track segment when the pair of arm members are in their first position and wherein each toy vehicle carriage is configured to release the toy vehicle from the toy vehicle carriage onto another track segment when the pair of arm members are in their second position, wherein the toy vehicle travels vertically as the pair of arm members move from their first position to their second position.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
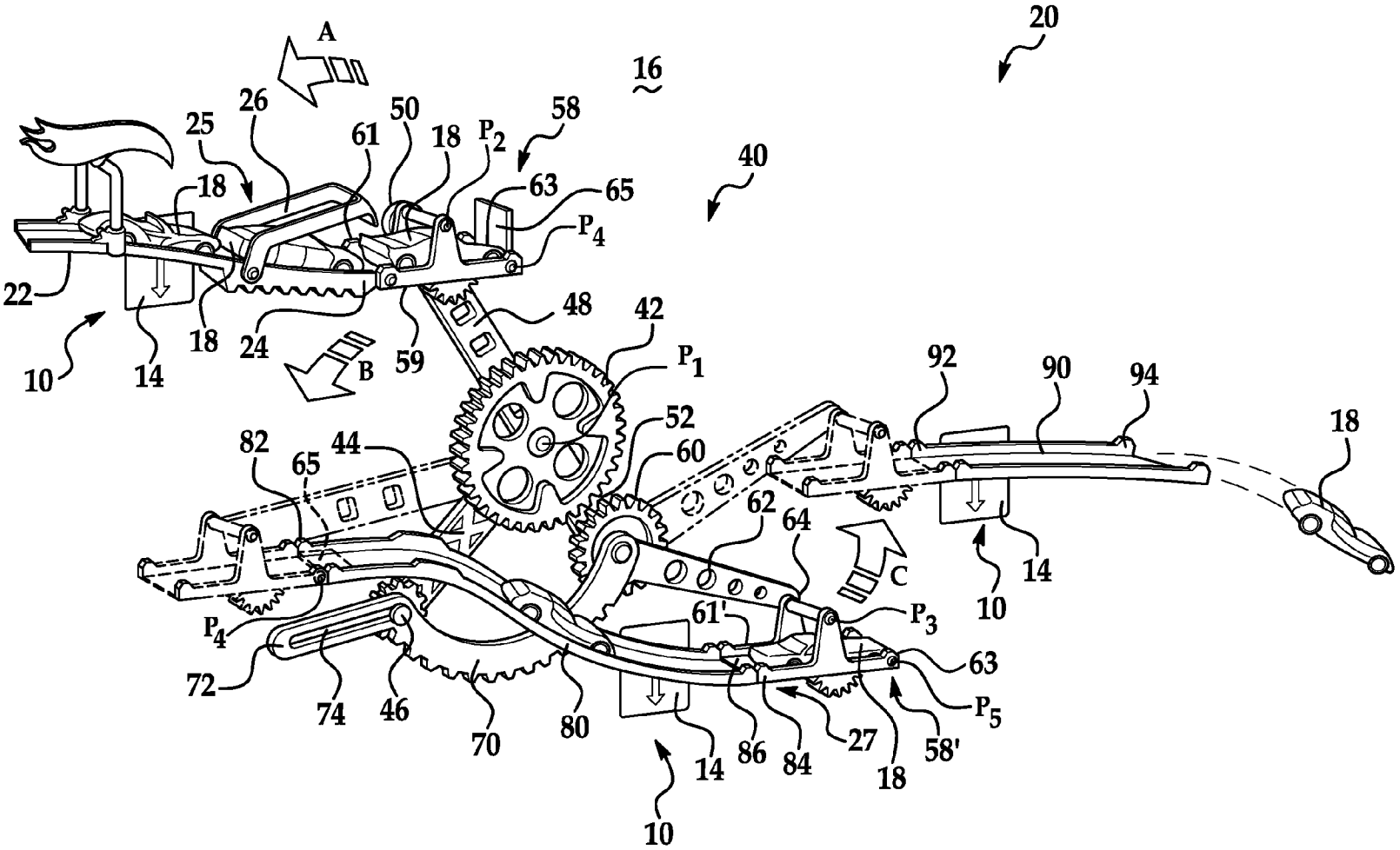
FIG. 1 is a perspective view of a toy vehicle track set according to one embodiment of the invention.

Referring now to the FIGS. a track set 20 in accordance with an exemplary embodiment of the present invention is illustrated. In one embodiment, the track set 20 may be mounted to a wall 16 via a plurality of wall mounts 10. Each wall mount 10 has a planar member 14 that is secured to a wall 16 via removable double-sided adhesive tape or other equivalent material. One non-limiting example of such adhesive tape is commercially available from 3M sold under the trademark COMMAND STRIP. In one embodiment, the wall mount 10 may be that described in commonly owned U.S. patent Ser. No. 13/220,364, filed on Aug. 29, 2011, and U.S. Provisional Patent Applications Ser. Nos. 61/377,743, filed on Aug. 27, 2010, and 61/480,793, filed on Apr. 29, 2011, the contents each of which are incorporated herein by reference thereto in their entirety. It should be appreciated that while embodiments of this invention illustrate the track set 20 mounted to a wall 16, the claimed invention should not be so limited. In other embodiments the track set 20 may include support stands that allow the track set 20 to be a free standing track set that rests on a horizontal play surface. In yet other embodiments, portions of the track set 20 may be mounted to a wall 16 while other portions of the track set 20 may include support stands for resting on a playing surface.

Figure 2:
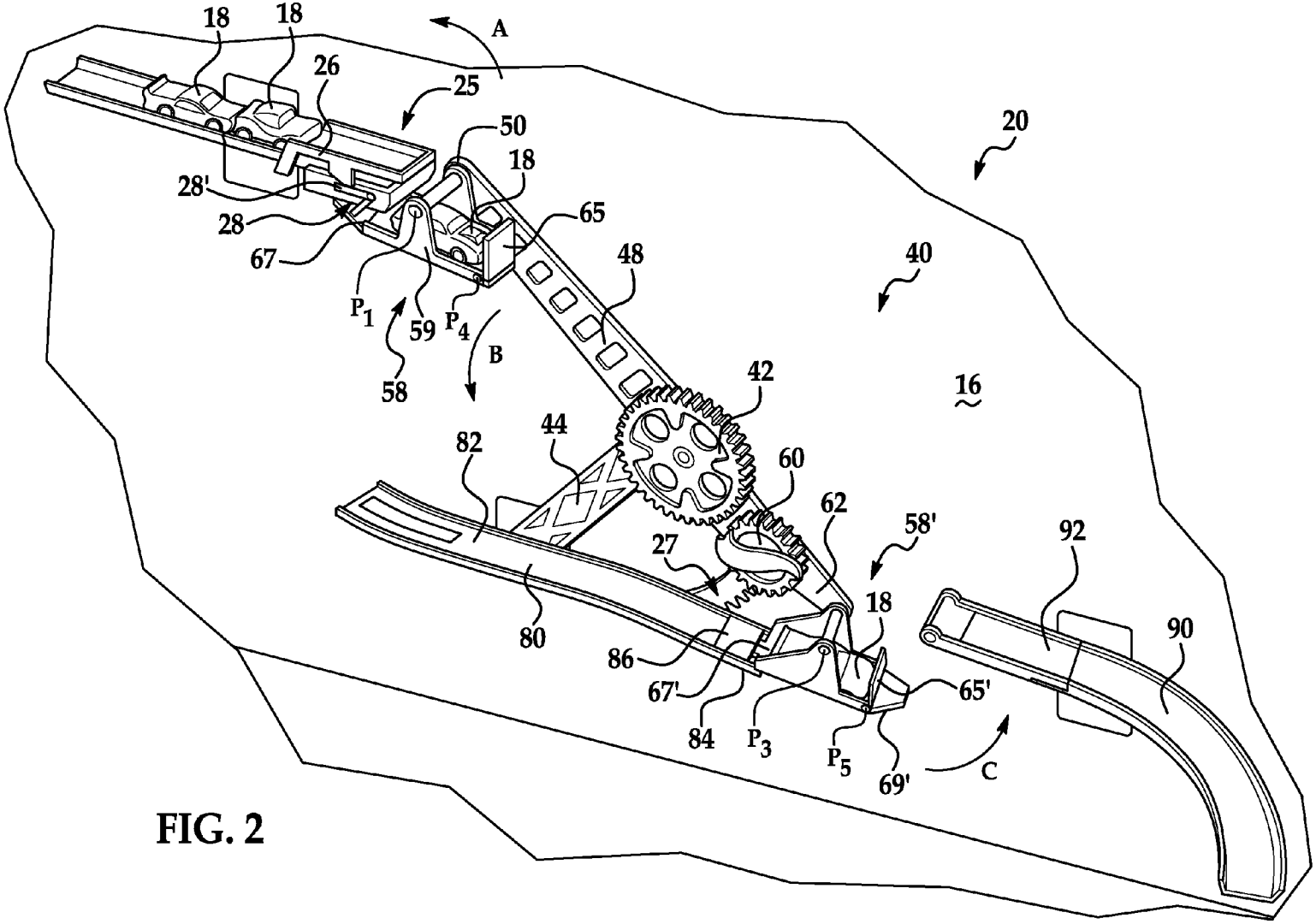
FIG. 2 is a perspective view of a toy vehicle track set illustrated in FIG. 1 in a first position.
Figure 3:
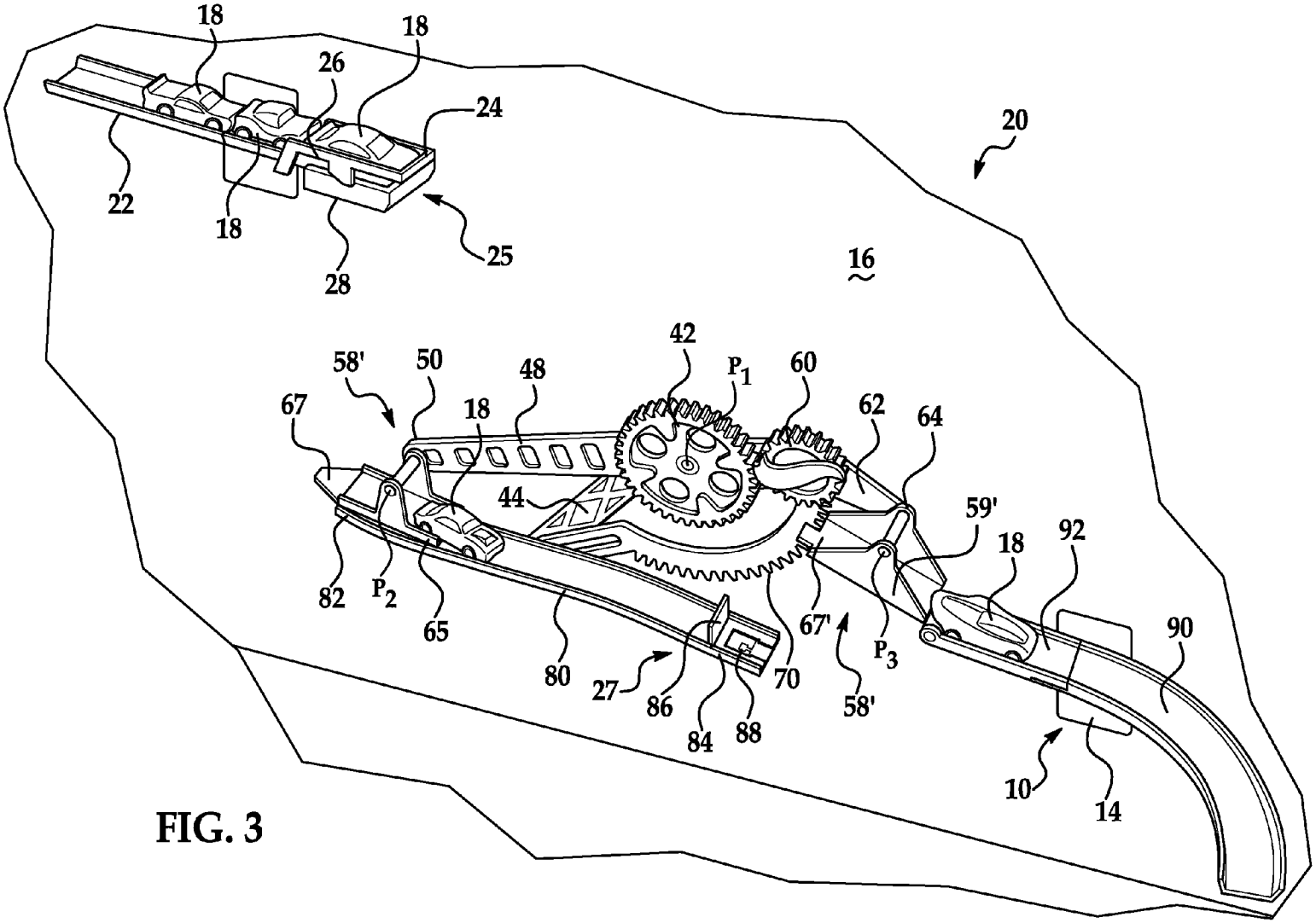
FIG. 3 is a perspective view of a toy vehicle track set illustrated in FIG. 1 in a second position.

The track set 20, as illustrated in FIGS. 1-3, includes a plurality of track segments, for example a start platform 22, a first track segment 80, and a second track segment 90. The plurality of track segments 22, 80, 90 provides a path of travel for a toy, such as a toy vehicle 18. The start platform 22, first track segment 80, and second track segment 90 may be selectively disconnected from one another and may be separated by a vertical distance, a horizontal distance, or both. In one embodiment, each track segment is oriented such that a gravitational force causes the toy vehicle 18 to move along the path of travel of the track set 20.

The start platform 22 includes a toy vehicle feed system 25 positioned adjacent a first end 24 for releasably retaining a toy vehicle 18. The toy vehicle feed system 25 includes a gate 26 pivotally coupled to the start platform 22 such that the gate 26 is configured to rotate out of the path of travel along the track set 20, in the direction indicated by arrow A. The gate 26 includes an activation device 28, such as a lever 28' for example, such that when the activation device 28 is actuated, the lever 28' is rotated about a pivot axis and the gate 26 rotates away from the start platform 22. In one embodiment, the activation device 28 is a lever arm 28' that extends at an angle below the start platform 22. Application of a force to the activation device 28, for example from the moving carriage 58 as described below when it abuts or is adjacent to the start platform 22 or alternatively through a user's hand, causes the activation device 28, and therefore the gate 26 connected to the activation device 28, to rotate relative to the start platform 22. When the gate 26 is pivoted out of the path of travel of the track set 20, an individual toy vehicle is released from the feed system 25 and moves from the start platform 22 as a result of gravity. Once the force is removed from the activation device 28, the gravitational force on the activation device 28 and the gate 26 will cause the gate 26 to rotate back to a position that blocks that path of travel along the track set 20.

The first track segment 80 similarly includes an alternative toy vehicle feed system 27 for retaining and individually releasing a toy vehicle 18 along the track set 20. The toy vehicle feed system 27 includes a stop 86 that projects perpendicularly to the path of travel to inhibit movement of at least one toy vehicle 18. The stop 86 is pivotally mounted to the first track segment 80 near a second end 84 and is configured to rotate to a second position, wherein the stop 86 is no longer in the blocking position and is now parallel to the track segment 80 or, in other words, in a non-blocking position. When the stop 86 is in the second position, the toy vehicle 18 is free to move along the path of travel of the track set 20. In one embodiment, the stop 86 is moved by an actuator 88 such that when a force is applied to the actuator 88, for example from the moving carriage 58' as described below when it abuts or is adjacent to the second end 84 of the first track segment 80 or alternatively by a user applied force (e.g., hand, etc.), the stop 86 rotates to the second position, parallel to the first track segment 80. The actuator 88 may be a lever disposed adjacent the second end 84 of the first track segment 80.

A rotating arm assembly 40 is disposed generally centrally relative to the plurality of track segments 22, 80, 90. The rotating arm assembly 40 includes a fixed first gear 42, such as a spur gear for example. A fixed support 44 extends from the first gear 42 in the direction of the first end 82 of the first track segment 80. A first arm member 48 is pivotally mounted to the fixed first gear 42 by pin P1. Alternatively, the first fixed gear 42 and at least the first arm member 48 are rotatably fixed to the wall 16 via pin P1 and/or rotatably mounted to fixed support 44 via pin P1 and fixed support 44 is fixed to wall 16. A carriage 58 for receiving a toy vehicle 18 of the track set 20 is mounted to a distal, first end 50 of the first arm member 48. The carriage 58 is pivotally mounted to the first arm member 48 about a pin P2 such that as the rotating arm assembly 40 rotates, the carriage 58 remains relatively parallel to a play surface and/or the ground. The carriage 58 includes an open first end 61 for receiving a toy vehicle 18 from the start platform 22 and a closed second end 63 for retaining the toy vehicle 18 in the carriage 58 during movement of the rotating arm assembly 40. In some embodiments, the second end 63 of the carriage 58 includes a door 65 pivotally mounted to the carriage 58 such that the toy vehicle 18 may exit the carriage 58 through the second end 63 when the door 65 is rotated to an open position parallel to a base 59 of the carriage 58. The pin P4 of the door 65 may include a biasing means (not shown) that biases the door 65 into a closed position such that vehicles traveling onto carriage 58 are stopped by door 65. The carriage 58 mounted to the first arm member 48 may also include a projection 67 extending outwardly from the base 59 of the carriage 58 in the direction of the start platform 22. In some embodiments, the projection 67 is configured to engage and actuate the activation device 28 of the toy vehicle feed device 25 contacting lever 28'.

A second gear 60 is connected to the second, opposite end 52 of the first arm member 48 and is arranged in meshing engagement with the fixed first gear 42. Alternatively, second gear 16 does not contact gear 42. A second arm member 62 extends from the second gear 60 in the direction of a second end 84 of the first track segment 80. Another carriage 58', similar to the carriage 58 mounted to the first arm member 48, is pivotally mounted to the unattached end 64 of the second arm member 62 by a pin P3. A connector 70 may be disposed between the second gear 60 and the fixed support 44 such that the connector 70 is movable relative to the fixed support 44. In some embodiments, the end 72 of the connector 70 adjacent the fixed support 44 includes an elongated slot 76 within which a pin 46 protruding from the fixed support 44 is slidably received. The elongated slot 76 limits the movement of the first arm member 48 and the second arm member 62 about the fixed gear 42 as pin 46 slides within slot 74 as the first arm member 48 and the second arm member 62 move between their first and second positions.

The coupled first arm member 48 and second arm member 62 are configured to move simultaneously in the directions indicated by the arrows B and C, between a first position, shown in FIG. 1, and a second position illustrated in phantom in FIG. 1. When the pair of arm members 48, 62 are in the first position, the carriage 58 connected to the first arm member 48 is disposed adjacent the start platform 22, and the carriage 58' connected to the second arm member 62 is disposed adjacent the second end 84 of the first track segment 80. When the pair of arm members 48, 62 are rotated to the second position, the carriage 58 connected to the first arm member 48 is located adjacent the first end 82 of the first track segment 80, and the carriage 58'connected to the second arm member 62 is disposed near the first end 92 of the second track segment 90. Consequently, the vertical and horizontal spacing between the start platform 22 and the first track segment 80 may be dependent on the length of the first arm member 48, and the vertical and horizontal spacing between the first track segment 80 and the second track segment 90 is dependent on the length of the second arm member 90. Variations in the positioning of the plurality of track segments 22, 80, 90 may be made by similarly altering the length of the pair of arm members 48, 62. In one embodiment, the pin P1 coupling the first arm member 48 to the first gear 42 is surrounded by a biasing means (not shown), such as a torsion spring for example, such that the first arm member 48, and therefore the coupled second arm member 62, are biased back to their respective first positions.

When each of the pair of arm members 48, 62 is in the first position, the projection 67 of the carriage 58 connected to the first arm member 48 applies a force to the activation device 28 or lever 28' of the toy vehicle feed system 25. The gate 26 rotates to release a toy vehicle 18 from the start platform 22 onto the carriage 58 of the first arm member 48.

The weight of the toy vehicle 18 in the carriage 58 causes the first arm member 48 to rotate about the fixed gear 42 or P1, in the direction indicated by arrow B, to its second position. This movement similarly causes the second arm member 62 to move from its first position, in the direction indicated by arrow C, to its second position. When the first arm 48 is in the second position, the first carriage 58 is generally aligned with the first end 82 of the first track segment 80. In some embodiments, the toy vehicle 18 applies a force to the door 65 when the carriage 58 is in the second position adjacent the first track segment 80. The force of the toy vehicle 18 causes the door 65 to pivot about pin P4, thereby allowing the toy vehicle 18 to move from the carriage 58 to the first track segment 80. Once the toy vehicle 18 moves to the first track segment 80, the arm members 48, 62 are biased back to the first position. Also, a bottom portion of door 65 or the door 65 may be pivoted about pin P4 when the carriage 58' or a portion of door 65 makes contact with an end 82 of track segment 80 thus rotating the door 65 into a non-blocking position so that the toy vehicle 18 can exit therefrom.

Once released from carriage 58, the toy vehicle 18 travels along the first track segment 80 until it reaches the stop 86 of other toy vehicle feed system 27. As the pair of arm members 48, 62 bias back to the first position, a projection 67' from the base 59' of the carriage 58' mounted to the second arm member 62 engages the actuator 88 of the stop 86. The projection 67' applies a force to the actuator 88 such that the stop 86 rotates to a second position, thereby releasing the toy vehicle 18 from the first track segment 80 onto the carriage 58'. Rotation of the pair of arm members 48, 62 to the second position, either by an operator or as a result of another vehicle's presence in the first carriage 58, moves the second carriage 58' to a position adjacent a first end 92 of the second track segment 90. In one embodiment, the pivotable door 65' disposed at the second end 63' of the second carriage 58' includes a tab or lever 69' that extends from the door 65' in the direction of the second track segment 90. As the arm members 48, 62 rotate to the second position, the first end 92 of the second track segment 90 contacts the tab 69' of the door 65', causing the door 65' to rotate to an open position. This rotation of door 65' allows the toy vehicle 18 to move through the second end 63' of the carriage 58' onto the second track segment 90. The second end 94 of the second track segment may be the end of the track set 20 or alternatively may be connected to another track segment for extended play.

Figure 4:
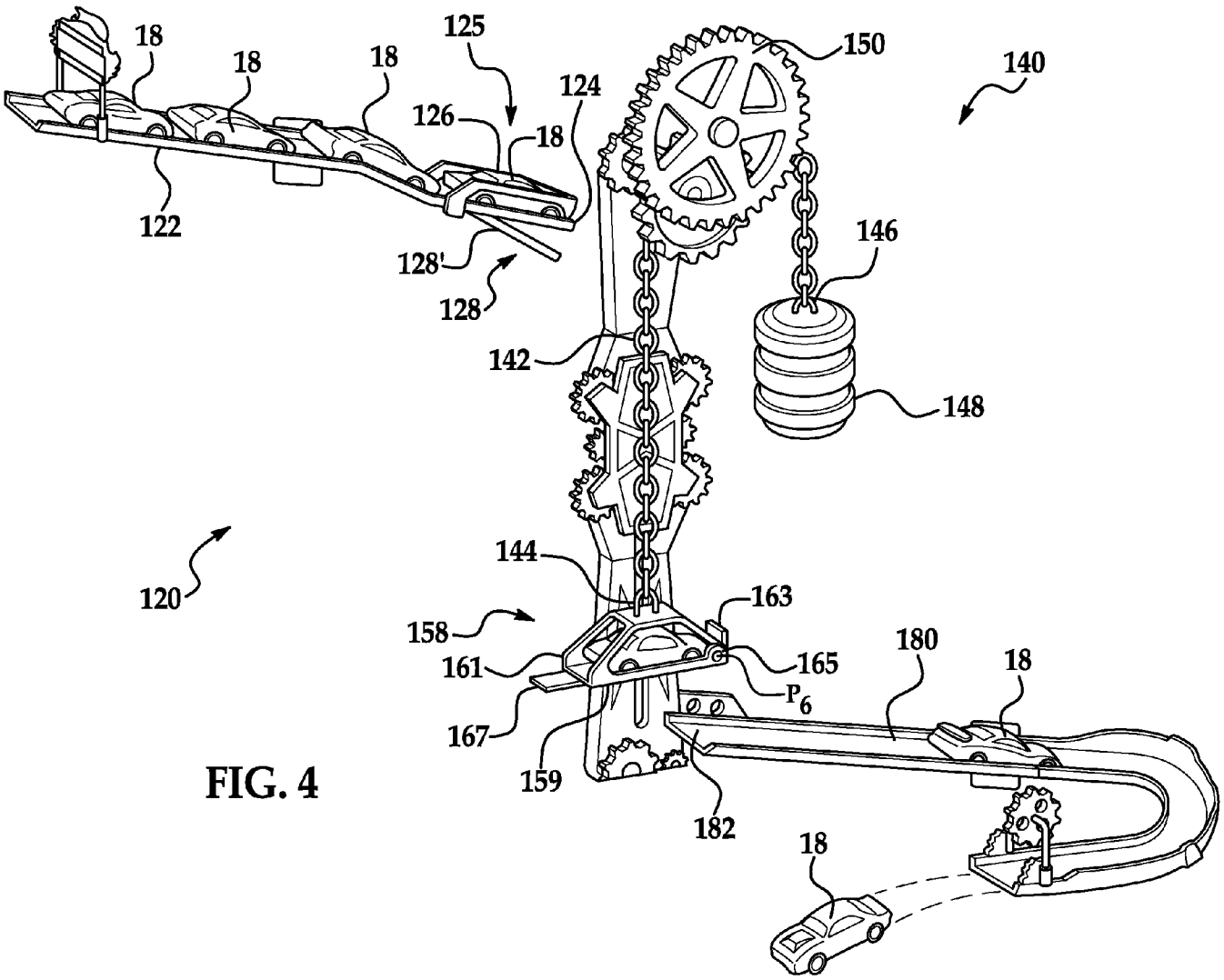
FIG. 4 is a perspective view of a toy vehicle track set according to one embodiment of the invention.
Figure 5:
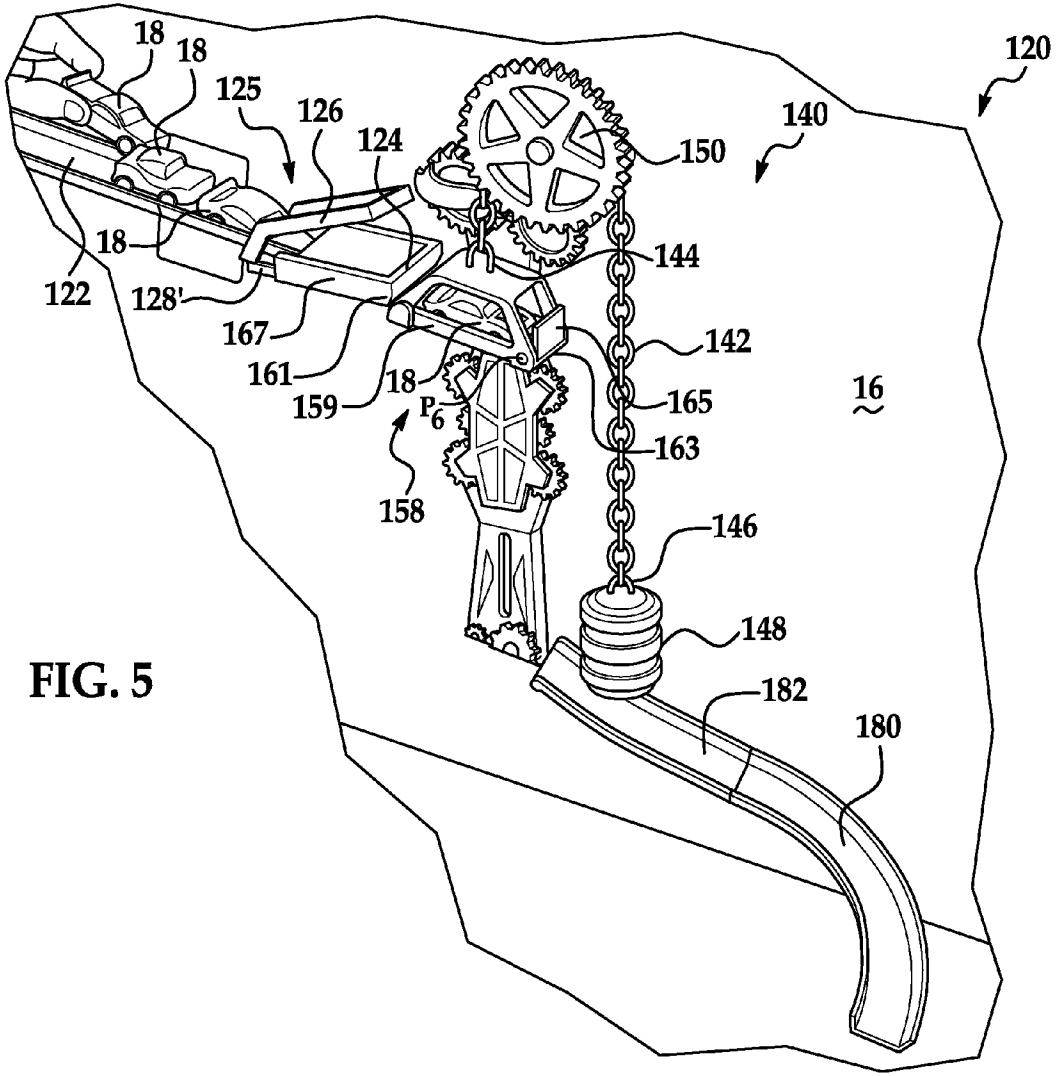
FIG. 5 is a perspective view of a toy vehicle track set illustrated in FIG. 4 in a first position.
Figure 6:
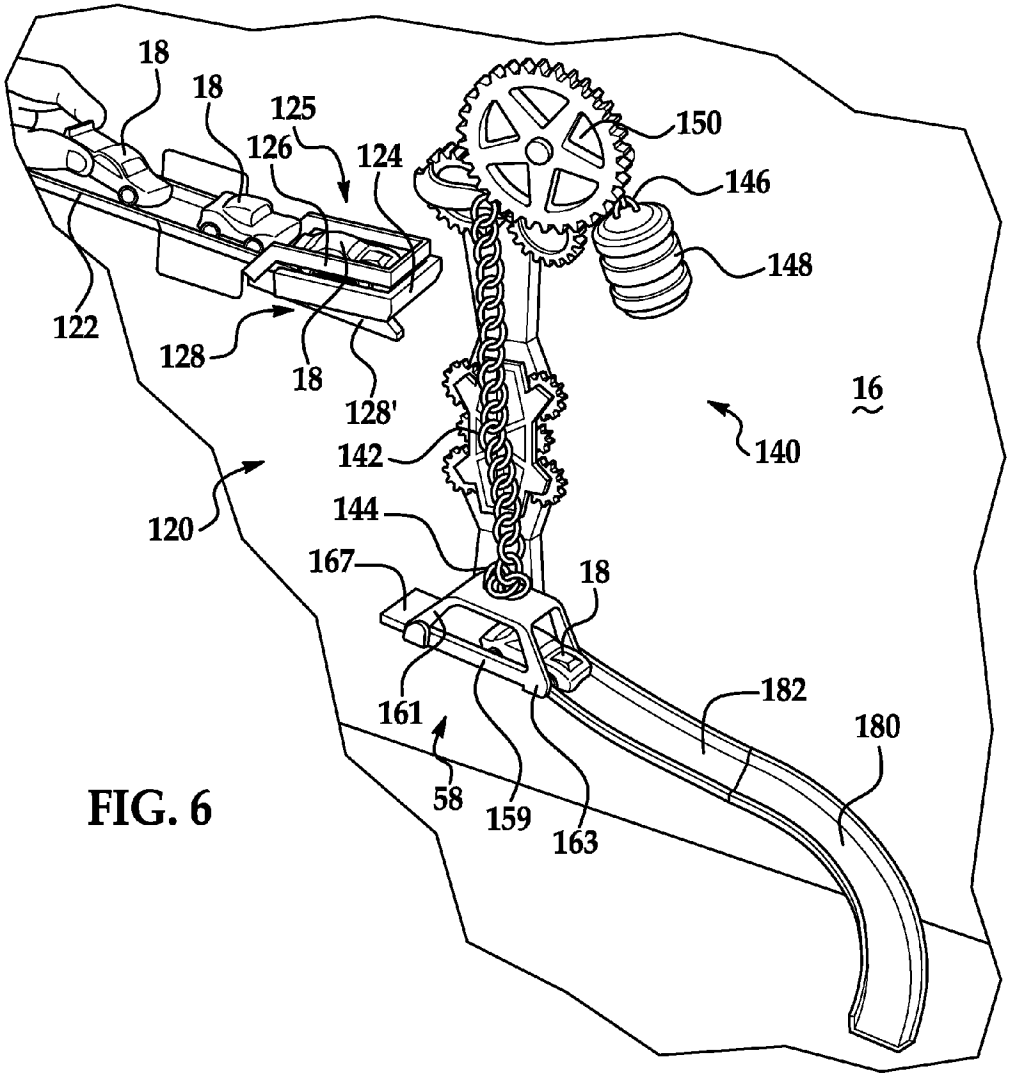
FIG. 6 is a perspective view of a toy vehicle track set illustrated in FIG. 4 in a second position.

Referring now to FIGS. 4-6, an alternate configuration of the toy vehicle track set 120 is illustrated. The track set 120 includes a plurality of disconnected track segments, such as a start platform 122 and a first track segment 180 for example. In one embodiment, the start platform 122 and the first track segment 180 are separated by a vertical distance. The start platform 122 may include a toy vehicle feed system 125 having a rotating gate 126 and an activation device 128 as described in the previous embodiment.

The track set 120 includes an elevator-type system 140 disposed between a terminal end 124 of the start platform 122 and a starting end 182 of the first track segment 180. A tension rope 142, such as a cable, chain or rope for example, is connected at a first end 144 to a carriage 158 configured to receive a toy vehicle 18, and is connected at a second, opposite end 146 to a counterweight 148. The tension rope 142 cooperates with a rotatable pulley 150 to move the carriage 158 between a first position (see FIG. 5) and a second position (see FIG. 6). The illustrated elevator-type system 140 has a 1:1 roping, such that the movement of the carriage 158 and the counterweight 148 are equal and in opposite directions. Alternative roping configurations, such as a system 140 having a 2:1 roping where the counterweight 148 moves only half the distance of the carriage 158 for example, are within the scope of the present invention.

The carriage 158 connected to the first end 144 of the tension rope 142 is configured to receive a toy vehicle 18 from the start platform 122. In one embodiment, the carriage 158 includes a projection 167 extending in the direction of the start platform 122 and also a pivotal door 165 adjacent an end 163 of the carriage 158 as previously disclosed. The carriage 158 and counterweight 148 are configured such that when the elevator-type system 140 is in a first position, the carriage 158 is disposed adjacent the start platform 122 and the counterweight 148 is positioned near the first track segment 180. When the elevator-type system 140 is in a second position, the carriage 158 is disposed adjacent the first end 182 of the first track segment 180, and the counterweight 148 is located near the pulley 150. The counterweight 148 has a mass greater than the mass of the carriage 158, and therefore, biases the elevator-type system 140 to a first position.

In the first position, the projection 167 from the carriage 158 applies a force to the lever 128' of the activation device 128 of the toy vehicle feed system 125 causing a toy vehicle 18 to be released from the start platform onto the carriage 158. In some embodiments, the combined weight of the carriage 158 and a toy vehicle 18 received within the carriage 158 is greater than the weight of the counterweight 148. Consequently, when a toy vehicle 18 is positioned within the carriage 158, gravity causes the elevator-type system 140 to move from the first position to the second position. When the carriage 158 is in the second position, the toy vehicle 18 applies a force to the door 165 of the carriage 158 causing the door 165 to pivot about pin P6 to an open position. Also, a bottom portion 165' of door 165 or the door 165 may be pivoted about pin P6 when the carriage 158 or a portion of door 165 makes contact with an end 182 of track segment 180 thus rotating the door 165 into a non-blocking position so that the toy vehicle 18 can exit therefrom.

Once the toy vehicle 18 has moved from the carriage 158 onto the first track segment 180, the door 165 of the carriage 158 may be spring biased back to a closed position. Similarly, once the toy vehicle 18 is on the first track segment 180, the gravitational force acting on the counterweight 148 may return the carriage 158 and the counterweight 148 to the first position because the weight of the carriage 158 alone is less than the weight of the counterweight 148.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A toy vehicle track set comprising:

a pair of arm members including a first arm member and a second arm member, the pair of arm members being movably mounted to the track set for movement between a first position and a second position; and a pair of toy vehicle carriages, where one of the pair of toy vehicle carriages is pivotally mounted to a distal end of one of the pair of arm members, and the other one of the pair of toy vehicle carriages is pivotally mounted to a distal end of the other one of the pair of arm members;

wherein each of the pair of arm members is coupled to one another such that as one of the arm members moves from the first position of the one of the arm members to the second position of the one of the arm members, the other of the arm members also moves from the first position of the other of the arm members to the second position of the other of the arm members.

2. The toy vehicle track set according to claim 1, wherein at least one of the pair of arm members is spring biased into the first position of the at least one of the pair of arm members.

3. The toy vehicle track set according to claim 2, wherein at least the first arm member is configured such that upon receipt of a toy vehicle within the carriage of the first arm member, the weight of the toy vehicle causes the first arm member to move from the first position of the first arm member to the second position of the first arm member, which in turn causes the second arm member to move from the first position of the second arm member to the second position of the second arm member.

4. The toy vehicle track set according to claim 1, further comprising: a toy vehicle feed system configured to releasably retain a plurality of toy vehicles that can be individually released onto the carriage of one of the arm members as it returns to the first position of the one of the arm members.

5. The toy vehicle track set according to claim 4, wherein the toy vehicle feed system includes an activation device and actuation of the activation device causes the toy vehicle feed system to release a toy vehicle.

6. The toy vehicle track set according to claim 5, wherein the toy vehicle feed system includes a gate pivotally mounted to a track segment, wherein actuation of the activation device causes the gate to pivot relative to the track segment, thereby releasing a stopped toy vehicle.

7. The toy vehicle track set according to claim 5, wherein at least one of the pair of carriages includes a projection for engaging the activation device of the toy vehicle feed system when the arm members of the pair of arm members are in the first position.

8. The toy vehicle track set according to claim 1, wherein at least one of the pair of carriages includes a closed end having a door rotatable between a closed position and an open position.

9. The toy vehicle track set according to claim 8, wherein the door is spring biased into the closed position.

10. The toy vehicle track set according to claim 9, wherein the door includes an outwardly projecting tab such that when the pair of arm members moves to a second position, an end of a track segment engages the tab, causing the door to rotate to an open position.

11. The toy vehicle track set according to claim 1, wherein the toy vehicle track set is configured for removable securement to a vertical surface.

12. The toy vehicle track set according to claim 1, wherein the toy vehicle track set is configured to be supported on one or more flat or horizontal surfaces.

13. A method of transferring toy vehicles vertically along a path of track set, the method including the steps of:

transferring the toy vehicles vertically along the path by a pair of arm members rotatably mounted to a vertical surface, the pair of arm members configured for movement about the track set for movement between a first position and a second position in order to transfer the toy vehicles vertically along the path;

pivotally mounting one of a pair of toy vehicle carriages to a distal end of one of the pair of arm members;

pivotally mounting the other one of the pair of toy vehicle carriages to a distal end of the other one of the pair of arm members; and wherein each of the pair of arm members are coupled to one another such that as one of the pair of arm members moves from the first position of the one of the pair of arm members to the second position of the one of the pair of arm members, the other one of the pair of arm members also moves from the first position of the other one of the pair of arm members to the second position of the other one of the pair of arm members and wherein each toy vehicle carriage of the pair of toy vehicle carriages is configured to receive a toy vehicle from a track segment when the pair of arm members are in the first position of the pair of arm members and wherein each toy vehicle carriage of the pair of toy vehicle carriages is configured to release the toy vehicle from the toy vehicle carriage onto another track segment when the pair of arm members are in the second position of the pair of arm members, wherein the toy vehicle travels vertically as the pair of arm members move from the first position of the pair of arm members to the second position of the pair of arm members.

* * * * *